US010584439B2

(12) United States Patent
Lv et al.

(10) Patent No.: US 10,584,439 B2
(45) Date of Patent: Mar. 10, 2020

(54) DRAINAGE MECHANISM OF A WASHING MACHINE

(71) Applicant: QINGDAO HAIER WASHING MACHINE CO., LTD., Qingdao, Shandong (CN)

(72) Inventors: Peishi Lv, Shandong (CN); Lin Yang, Shandong (CN); Gangjin Zhang, Shandong (CN); Yun Tian, Shandong (CN); Jianshe Liu, Shandong (CN)

(73) Assignee: QINGDAO HAIER WASHING MACHINE CO., LTD., Qingdao, Shandong (CN)

( * ) Notice: Subject to any disclaimer, the term of this patent is extended or adjusted under 35 U.S.C. 154(b) by 133 days.

(21) Appl. No.: 15/550,558

(22) PCT Filed: Nov. 23, 2015

(86) PCT No.: PCT/CN2015/095292

§ 371 (c)(1),
(2) Date: Aug. 11, 2017

(87) PCT Pub. No.: WO2016/127685

PCT Pub. Date: Aug. 18, 2016

(65) Prior Publication Data

US 2018/0038038 A1 Feb. 8, 2018

(30) Foreign Application Priority Data

Feb. 13, 2015 (CN) ..... 2015 1 0080136

(51) Int. Cl.
*D06F 39/08* (2006.01)
*D06F 37/12* (2006.01)

(52) U.S. Cl.
CPC ..... *D06F 39/08* (2013.01); *D06F 37/12* (2013.01); *D06F 39/083* (2013.01)

(58) Field of Classification Search
CPC ..... D06F 39/08; D06F 39/083; D06F 21/06; D06F 21/08; D06F 21/10; D06F 23/04; D06F 23/06; D06F 23/065; D06F 37/12
See application file for complete search history.

(56) References Cited

U.S. PATENT DOCUMENTS 5,152,159 A * 10/1992 Kabeya ..... D06F 39/083 68/12.02
2007/0186595 A1 8/2007 Iimori et al.

FOREIGN PATENT DOCUMENTS

CN 101139795 A 3/2008
CN 203238457 U 10/2013
(Continued)

OTHER PUBLICATIONS

International Search Report (PCT/ISA/210) dated Feb. 26, 2016, by the State Intellectual Property Office of the P.R. China as the International Searching Authority for International Application No. PCT/CN2015/095292.

(Continued)

*Primary Examiner* — David G Cormier
(74) *Attorney, Agent, or Firm* — Buchanan Ingersoll & Rooney PC

(57) ABSTRACT

A drainage mechanism of a washing machine having an inner tub and an outer tub includes a water sealing cover, a lever structure and a driving device, a resistance arm end of the lever structure is connected with the water sealing cover, the driving device for driving the lever structure to work is arranged at an driving arm end of the lever structure, a drainage outlet is formed in a bottom wall of the inner tub, and the lever structure is driven by the driving device and drives the water sealing cover to close the drainage outlet in the washing and rinsing procedures and to open the drainage outlet in a draining procedure. The resistance arm end of the lever structure moves upwards and downwards to drive the (Continued)

water sealing cover to close and open the drainage outlet, thereby implementing drainage.

10 Claims, 9 Drawing Sheets

(56) References Cited

FOREIGN PATENT DOCUMENTS

| | | | |
|---|---|---|---|
| CN | 103898708 | A | 7/2014 |
| KR | 1019930004707 | B1 | 6/1993 |

OTHER PUBLICATIONS

Written Opinion (PCT/ISA/237) dated Feb. 26, 2016, by the State Intellectual Property Office of the P.R. China as the International Searching Authority for International Application No. PCT/CN2015/095292.

* cited by examiner

DRAINAGE MECHANISM OF A WASHING MACHINE

TECHNICAL FIELD

The present invention relates to the technical field of washing machines, and particularly relates to a drainage mechanism of a washing machine.

BACKGROUND

With the improvement of the living standards, people have higher and higher demands on washing machines. A washing machine with a simple clothes washing function cannot meet the demands of people. Particularly, energy and development have become a theme of social development, so people do not only have a basic clothes washing demand on the washing machine, but also take energy saving as an important factor to measure the washing machine. An ordinary pulsator washing machine has a large amount of water between an inner tub and an outer tub in a water supplying procedure, so that the water outside the inner tub is wasted in a washing procedure. Currently, a washing machine without holes in the lower part of an inner tub is developed, and in such a washing machine, only the upper end part of the inner tub is provided with dehydration drainage holes, so that water only exists in the inner tub, but does not exist between the inner tub and an outer tub when the washing machine washes or rinses clothes after water supply is completed; therefore, water in such a washing machine can be fully utilized, and such a washing machine saves water with an amount of 40% in the water supplying procedure compared with other washing machines, and meanwhile, the amount of a detergent used in such a washing machine can also be reduced; furthermore, the amount of the water supplied into the inner tub is reduced, so that the load of the washing machine is reduced to a certain extent, and more electricity is saved.

However, the washing machine without holes in the bottom wall of the inner tub also has a defect that as no dehydration drainage hole is formed in the lower part of the inner tub, the water cannot be drained in time in a dehydrating procedure, the dehydrating procedure starts slowly with great vibrations and has a relatively large energy consumption, and the dehydrated clothes have water in a relatively high ratio.

Therefore, how to better solve the drainage problem of such a washing machine is important to improve use experience of users.

SUMMARY

To solve the problems described above, the present invention provides a drainage mechanism of a washing machine. Specifically, a technical solution adopted by the present invention is as follows.

The drainage mechanism of a washing machine is applicable to a washing machine which performs washing and rinsing procedures without water between an inner tub and an outer tub, wherein the washing machine includes an inner tub without holes in the lower part of a tub side wall, and the drainage mechanism of the inner tub comprises a water sealing cover, a lever structure and a driving device. A resistance arm end of the lever structure is connected with the water sealing cover. The driving device for driving the lever structure to work is arranged at an driving arm end of the lever structure, a drainage outlet is formed in a bottom wall of the inner tub, and the lever structure is driven by the driving device and drives the water sealing cover to close the drainage outlet in the washing and rinsing procedures and to open the drainage outlet in a draining procedure.

Further, the lever structure comprises a lever and a lever support, the lever support is fixed on the outer side of the bottom wall of the inner tub, the lever is rotatably mounted on the lever support, and the driving device drives the lever to rotate around the lever support.

Further, the water sealing cover is connected with the resistance arm end of the lever structure through a hinge, the water sealing cover freely rotates around a center line of the resistance arm end of the lever structure, and a movable included angle of 0-15 degrees is formed between the water sealing cover and the bottom wall of the inner tub, preferably the movable included angle is 5 degrees.

Further, the driving device comprises a cam, the cam is rotatably mounted on the outer side of the bottom wall of the inner tub, a contour surface of the cam is arranged above the driving arm end of the lever, and the contour surface presses/loosens an driving arm of the lever along with rotating of the cam to implement lever motion of the lever structure.

Further, the cam is further provided with a first limiting part and a second limiting part, the first limiting part is used for limiting the cam so that the cam stops rotating at a position where the water sealing cover opens the drainage outlet. And the second limiting part is used for limiting the cam so that the cam stops rotating at a position where the water sealing cover closes the drainage outlet.

Further, a torsion spring for returning the lever when the contour surface loosens is arranged between the lever and the lever support of the lever structure, and the torsion spring deforms when the contour surface presses the driving arm of the lever and recovers when the contour surface loosens the driving arm of the lever.

Further, the washing machine comprises an outer tub coaxially mounted outside the inner tub;

the driving device further comprises a first stop rod assembly and a second stop rod assembly, both of which are mounted on a bottom wall of the outer tub, and the cam is provided with a first shift rod and a second shift rod; and when the inner tub rotates in a forward direction, the first stop rod assembly stops the first shift rod so that the cam rotates in a reverse direction, the contour surface presses the lever structure, and the water sealing cover opens the drainage outlet; and when the inner tub rotates in the reverse direction, the second stop rod assembly stops the second shift rod so that the cam rotates in the forward direction, the contour surface loosens the lever structure, and the water sealing cover closes the drainage outlet.

Further, each of the first stop rod assembly and the second stop rod assembly comprises a stop rod capable of moving upwards and downwards;

the first stop rod assembly is arranged outside the second stop rod assembly, and a length of the first shift rod is larger than a length of the second shift rod, so that the stop rod of the first stop rod assembly only stops the first shift rod when moving upwards; and the length of the stop rod of the second stop rod assembly is smaller than the length of the stop rod of the first stop rod assembly, and a distance between the second shift rod and the bottom wall of the outer tub is smaller than a distance between the first shift rod and the bottom wall of the outer tub, so that the stop rod of the second stop rod assembly only stops the second shift rod when moving upwards.

Further, each of the first stop rod assembly and the second stop rod assembly comprises a sealing sleeve and the stop rod capable of moving upwards and downwards, an upper part of each stop rod passes through the bottom wall of the outer tub and is located between the inner tub and the outer tub, the lower part of the stop rod is located at the exterior of the bottom wall of the outer tub, each sealing sleeve is sleeved on the upper part of the stop rod and extends and contracts along with the movement of the corresponding stop rod, and another end of the sealing sleeve is in seal connection with the bottom wall of the outer tub.

Further, each of the first stop rod assembly and the second stop rod assembly further comprises a compression spring, the compression spring is arranged at a lower part of the stop rod, one end of the compression spring abuts against the bottom wall of the outer tub, and the other end of each compression spring abuts against the lower end of the stop rod; and the compression spring is compressed when the stop rod moves upwards and is used for providing an elastic force for the corresponding stop rod to make the corresponding stop rod to move downwards and return.

Further, the driving device further comprises a press plate, a support, a pull rod and a traction motor, the support is fixed on the outer side of the bottom wall of the outer tub, the pull rod is rotatably mounted on the support, one end of the pull rod is connected with the traction motor, another end of the pull rod is fixedly connected with the press plate, and two ends of the press rod respectively press the first stop rod assembly and the second stop rod assembly; and the pull rod and the press plate rotate around the support under the traction of the traction motor, and when one end of the press plate moves upwards and presses the first stop rod assembly to move upwards, another end of the press plate moves downwards and the second stop rod assembly moves downwards.

According to the present invention, only the upper part of the side wall of the inner tub is circumferentially provided with dehydration drainage holes, the dehydration drainage holes are formed in positions above the maximum water level of the inner tub of the washing machine and are used for draining dehydrated water in a dehydrating procedure, and other parts of the side wall of the inner tub are designed to be closed and are not provided with any through-hole structure. Meanwhile, the drainage outlet with a relatively large aperture is formed in the bottom wall of the inner tub, the drainage outlet is closed in the washing and rinsing procedures and is opened in the draining procedure, and other parts of the bottom wall of the inner tub are designed to be closed.

According to the present invention, the drainage mechanism is applicable to a washing machine which performs washing and rinsing procedures without water between the inner tub and the outer tub, the drainage outlet is formed in the bottom wall of the inner tub, the water sealing cover of the drainage mechanism closes the drainage outlet under the action of the lever structure in the washing or rinsing procedure, the water sealing cover opens the drainage outlet under the action of the lever structure in the draining procedure, and the lever structure is driven by the driving device to implement lever motion. Therefore, according to the drainage mechanism provided by the present invention, the resistance arm end of the lever structure moves upwards and downwards to drive the water sealing cover to close and open the drainage outlet to implement drainage; besides, the drainage mechanism provided by the present invention has a simple structure, is convenient to mount and is very valuable for market popularization.

REFERENCE SIGNS

1—inner tub; 2—torsion spring; 3—lever; 4—roller; 5—frame-shaped structure; 6—lever support; 7—water retaining rib; 8—water sealing cover; 9—first shift rod; 10—contour surface; 11—second shift rod; 12—cam; 13—outer tub; 14—tubdrainage outlet of outer tub; 15—groove structure; 16—first stop rod assembly; 17—second stop rod assembly; 18—stretching wire; 19—traction motor; 20—press plate; 21—support; 22—pull rod; 23—stop rod; 24—nut; 25—sealing sleeve; 26—fixed disk; 27—compression spring; 28—fixed seat; 29—stop nut; 34—first limiting part; 35—second limiting part; 36—basic curved surface; 37—sliding curved surface; and 38—non-return curved surface.

DETAILED DESCRIPTION

A drainage mechanism of a washing machine of the present invention is described in detail below in conjunction with the drawings.

Figure 1:
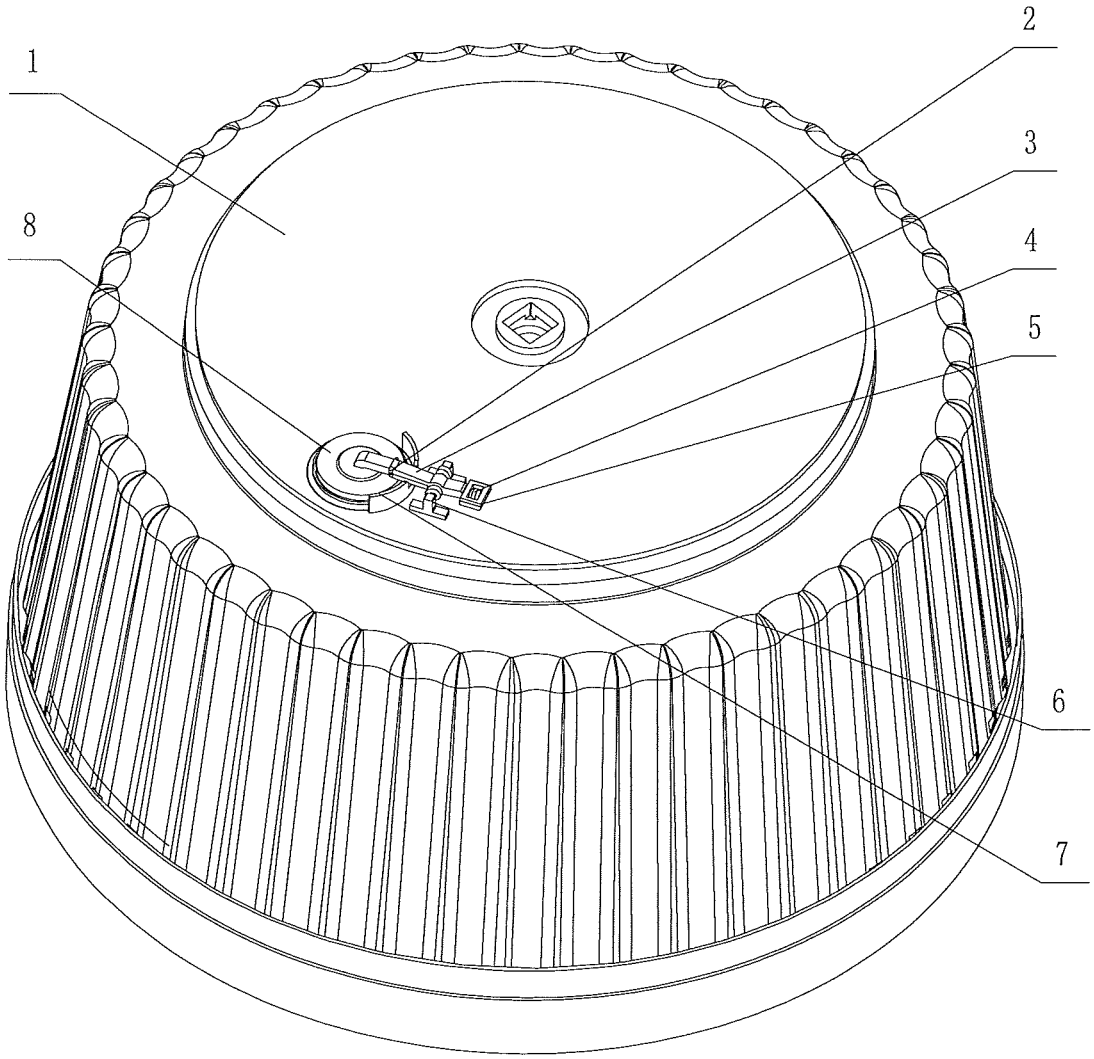
FIG. 1 is a stereoscopic view of a drainage structure mounted at the bottom of an inner tub of the present invention.

As shown in FIG. 1, a drainage mechanism of a washing machine is applicable to a washing machine which performs washing and rinsing procedures without water between an inner tub and an outer tub. The drainage mechanism comprises a water sealing cover 8, a lever structure and a driving device. A resistance arm end of the lever structure is connected with the water sealing cover 8, the driving device for driving the lever structure to work is arranged at a driving arm end of the lever structure. A drainage outlet is formed in a bottom wall of the inner tub 1. The lever structure is driven by the driving device to make the water sealing cover 8 close the drainage outlet in the washing and rinsing procedures and open the drainage outlet in a draining procedure.

According to the present invention, only the upper part of a side wall of the inner tub 1 is provided with dehydration drainage holes in a circle. The dehydration drainage holes are formed in positions above the maximum water level of the inner tub of the washing machine and are used for draining dehydrated water in a dehydrating procedure, and other parts of the side wall of the inner tub 1 are designed to be closed and are not provided with any through-hole structure. Meanwhile, the drainage outlet with a larger aperture is formed in the bottom wall of the inner tub 1. The drainage outlet is closed in the washing and rinsing procedures and is opened in the draining procedure, and other parts of the bottom wall of the inner tub 1 are designed to be closed.

According to the present invention, the drainage mechanism is applicable to the washing machine which performs the washing and rinsing procedures without water between the inner tub and the outer tub. The drainage outlet is formed in the bottom wall of the inner tub 1. The water sealing cover 8 of the drainage mechanism closes the drainage outlet under the action of the lever structure in the washing or rinsing procedure, and the water sealing cover 8 opens the drainage outlet under the action of the lever structure in the draining procedure, and the lever structure is driven by the driving device to implement lever motion. Therefore, according to the drainage mechanism provided by the present invention, the resistance arm end of the lever structure moves upwards and downwards to drive the water sealing cover 8 to close and open the drainage outlet to implement drainage. Besides, the drainage mechanism provided by the present invention has a simple structure, is convenient to mount and is very valuable for market popularization.

As a preferred embodiment of the present invention, the lever structure comprises a lever 3 and a lever support 6, and the lever support 6 is fixed on the outer side of the bottom wall of the inner tub 1. The middle part of the lever 3 is rotatably mounted on the lever support 6. The water sealing cover 8 is connected with the resistance arm end of the lever 3, the driving device is arranged at the driving arm end of the lever 3, and the driving device drives the lever 3 to rotate around the lever support 6.

In the present invention, the resistance arm end of the lever 3 is connected with the water sealing cover 8, the driving arm end of the lever 3 is connected with the driving device. Furthermore, the lever structure provided by the present invention is arranged on the outer side of the bottom wall of the inner tub 1. Therefore, the driving arm end is driven by the driving device to move upwards, the resistance arm end drives the water sealing cover 8 to move downwards, and the drainage outlet is opened. The driving arm end is driven by the driving device to move downwards, the resistance arm end drives the water sealing cover 8 to move upwards, and the drainage outlet is closed. Therefore, the drainage mechanism provided by the present invention utilizes the lever structure, and the drainage outlet is opened or closed under the action of the lever, which is more reliable.

As a preferred embodiment of the present invention, the water sealing cover 8 is connected with the resistance arm end of the lever structure through a hinge, and the water sealing cover 8 can freely rotate around a center line of the resistance arm end of the lever structure. A movable included angle of 0-15 degrees is formed between the water sealing cover 8 and the bottom wall of the inner tub, preferably the movable included angle is 5 degrees. The lever structure has a straight-line moving path, so it may occur that a part of the water sealing cover 8 becomes in contact with the drainage outlet firstly while another part of the water sealing cover 8 is not in contact with the drainage outlet when the water sealing cover 8 covers the drainage outlet, resulting in un-tight coverage of the drainage outlet and causing water leakage. When the water sealing cover 8 is connected with the lever structure by the hinge, the water sealing cover 8 has a certain movement angle, so that the water sealing cover 8 covers the drainage outlet more conveniently.

As a preferred embodiment of the present invention, a water retaining rib 7 is arranged on the outer circumference of the drainage outlet of the inner tub 1, and the water retaining rib 7 is mainly used for preventing water flows from scouring the lever structure when water is drained through the drainage outlet, which may cause instability or even damage of the lever structure. Further, the water retaining rib 7 is provided with a gap at a position corresponding to the lever 3 in order to prevent the water retaining rib 7 from obstructing normal rising and descending of the lever 3 and to help the water sealing cover 8 to close and open the drainage outlet smootherly. The water retaining rib 7 is only used for reducing the water flows flowing towards the lever structure, and preferably, the water retaining rib 7 is arranged on one side close to the lever structure of the drainage outlet.

It is a key point of the present invention how the lever structure implements the lever motion to drive the water sealing cover 8 to open and close the drainage outlet. Therefore, the present invention adopts the following technical solution to drive the lever structure to implement the lever motion.

Figure 2:
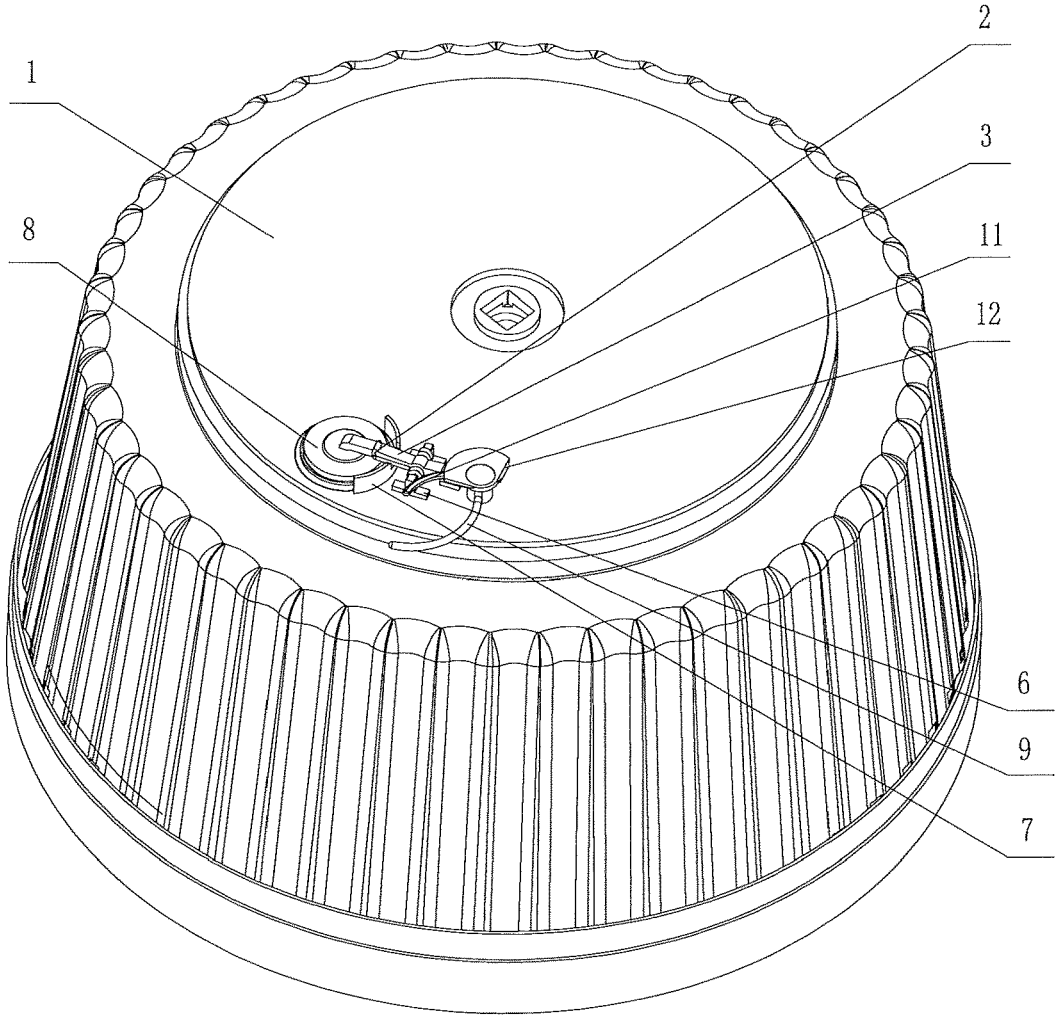
FIG. 2 is another stereoscopic view of a drainage structure mounted at the bottom of an inner tub of the present invention.

As shown in FIG. 2, the driving device provided by the present invention comprises a cam 12, and the cam 12 is rotatably mounted on the outer side of the bottom wall of the inner tub 1. A contour surface 10 of the cam 12 is in contact with the driving arm end of the lever 3 and the contour surface 10 presses or loosens an driving arm of the lever 3 along with the rotating of the cam 12 to implement the lever motion of the lever structure.

Therefore, in the present invention, different curved surfaces of the contour surface 10 come into contact with the driving arm end of the lever 3 during rotation of the cam 12. When a surface with a large curvature radius comes into contact with the driving arm end of the lever 3, the cam 12 presses the driving arm of the lever 3, the driving arm end of the lever 3 is pressed to move upwards, and the resistance arm end of the lever 3 moves downwards to drive the water sealing cover 8 to open the drainage outlet. When a surface with a small curvature radius comes into contact with the driving arm end of the lever 3, the cam 12 loosens the driving arm of the lever 3, the driving arm end of the lever 3 moves downwards and returns, and the resistance arm end of the lever 3 moves upwards to drive the water sealing cover 8 to close the drainage outlet.

In the present invention, the contour surface 10 at least comprises a first curved surface, a second curved surface and a third curved surface. The curvature radius of the first curved surface gradually increases, the curvature radius of the second curved surface is equal to a maximum value of the curvature radius of the first curved surface, and the curvature radius of the third curved surface is slightly smaller than the curvature radius of the second curved surface. Therefore, according to the present invention, the first curved surface of the contour surface 10 is in contact with the driving arm end of the lever 3 when the water sealing cover 8 closes the drainage outlet. The first curved surface and the second curved surface separately come into contact with the driving arm end of the lever 3 when the contour surface 10 rotates along with the cam 12. The contour surface 10 continuously rotates after the second curved surface with the maximum curvature radius comes into contact with the driving arm end of the lever 3. The contour surface 10 stops rotating along with the cam 12 when the third curved surface comes into contact with the driving arm end of the lever 3. And at this point, the third curved surface presses the driving arm end of the lever 3, and the water sealing cover 8 opens the drainage outlet. In this way, after the cam 12 stops rotating, the cam 12 can be prevented from reversely rotating as the curvature radius of the third curved surface is slightly smaller than the curvature radius of the second curved surface, thereby ensuring that the water sealing cover 8 opens the drainage outlet more reliably.

In the present invention, a frame-shaped structure 5 is arranged at the terminal of the driving arm end of the lever 3. A roller 4 is rotatably mounted in the frame-shaped structure 5, and the roller 4 is in contact with the contour surface 10 of the cam 12, so that contact friction between the cam 12 and the driving arm end of the lever 3 can be reduced, transition is smoother and no noise is generated.

In the present invention, opening of the drainage outlet by the water sealing cover 8 is mainly implemented by pressing the driving arm end of the lever 3 by the cam 12. And closing of the drainage outlet by the water sealing cover 8 is implemented by move-downwards of the driving arm end of the lever 3 to restore after the cam 12 loosens the driving arm end of the lever 3. So the key point to ensure that the water sealing cover 8 closes the drainage outlet is to ensure that the driving arm end of the lever 3 returns when the cam 12 loosens the driving arm end of the lever 3. Therefore, as a preferred embodiment of the present invention, a torsion spring 2, for returning the lever 3 when the contour surface 10 loosens, is arranged between the lever 3 and the lever support 6 of the lever structure, and the torsion spring 2 deforms when the contour surface 10 presses the driving arm of the lever 3 and recovers when the contour surface 10 loosens the driving arm of the lever 3.

In the present invention, the torsion spring 2 deforms when the cam 12 presses the lever 3 and has a certain elastic force. The torsion spring 2 applies the elastic force to the lever 3 in order to recover the deformation when the cam 12 loosens the lever 3, so that the driving arm end of the lever 3 moves downwards. In the present invention, the returning of the lever 3 can be implemented through the torsion spring 2, and the torsion spring 2 has a simple structure, is convenient to mount and is reliable and efficient.

The above technical solution solves the driving problem of the lever 3, but how to implement rotation of the cam 12 is a key point to implement the lever motion of the lever 3, and specifically, the following technical solution is adopted.

As shown in FIG. 3, FIG. 4, FIG. 5 and FIG. 6, the washing machine provided by the present invention comprises the inner tub 1 coaxially mounted inside an outer tub 13.

In the present invention, the driving device further comprises a first stop rod assembly 16 and a second stop rod assembly 17, both of which are mounted on a bottom wall of the outer tub 13. The cam 12 is provided with a first shift rod 9 and a second shift rod 11; and when the inner tub 1 rotates in a forward direction, the first stop rod assembly 16 stops the first shift rod 9 so that the cam 12 rotates in a reverse direction, the contour surface 10 presses the lever structure, and the water sealing cover 8 opens the drainage outlet. When the inner tub 1 rotates in the reverse direction, the second stop rod assembly 17 stops the second shift rod 11 so that the cam 12 rotates in the forward direction, the contour surface 10 loosens the lever structure, and the water sealing cover 8 closes the drainage outlet.

In the present invention, the rotation in the forward direction or the reverse direction does not limit rotation of the inner tub 1 in a constant direction, but only limits rotation of the inner tub 1 in two directions in the draining procedure. For example, when a clockwise direction is the forward direction, a counterclockwise direction is the reverse direction, vice versa. In the accompanying drawings of the present invention, the inner tub 1 rotates in the clockwise direction as the forward direction, and the inner tub 1 rotates in the counterclockwise direction as the reverse direction. In the present invention, the inner tub 1 rotates in two directions in order to implement the opening of the water sealing cover 8 before draining and the closing of the water sealing cover 8 after the draining is completed.

As a preferred embodiment of the present invention, each of the first stop rod assembly 16 and the second stop rod assembly 17 comprises a stop rod 23 capable of moving upwards and downwards. The stop rod 23 of the first stop rod assembly 16 and the stop rod 23 of the second stop rod assembly 17 need to act on the first shift rod 9 and the second shift rod 11, respectively. The cam 12 cannot rotate and return if action objects are wrong.

Therefore, the first stop rod assembly 16 is arranged outside the second stop rod assembly 17, and the length of the first shift rod 9 is larger than the length of the second shift rod 11, so that the stop rod 23 of the first stop rod assembly 16 only stops the first shift rod 9 when moving upwards.

In this way, the first stop rod assembly 16 is arranged outside a free end of the second shift rod 11, the first stop rod assembly 16 cannot stop the second shift rod 11 and only can stop the first shift rod 9 when moving upwards. The first shift rod 9 drives the cam 12 to rotate in the reverse direction as being stopped by the first stop rod assembly 16, the driving arm end of the lever 3 is pressed to move upwards, the resistance arm end moves downwards, and the water sealing cover 8 opens the drainage outlet.

In the present invention, the length of the stop rod 23 of the second stop rod assembly 17 is smaller than the length of the stop rod 23 of the first stop rod assembly 16, and a distance between the second shift rod 11 and the bottom wall of the outer tub 13 is smaller than a distance between the first shift rod 9 and the bottom wall of the outer tub 13, so that the stop rod 23 of the second stop rod assembly 17 only stops the second shift rod 11 when moving upwards.

In this way, the height of the stop rod 23 of the second stop rod assembly 17 after the stop rod 23 moves upwards can only allow the stop rod 23 to stop the second shift rod 11 rather than the first shift rod 9. The second shift rod 11 drives the cam 12 to rotate in the forward direction as being stopped by the stop rod 23 of the second shift rod, the driving arm end of the lever 3 is loosened to move downwards, the resistance arm end moves upwards, and the water sealing cover 8 closes the drainage outlet.

In the present invention, the lengths of the first shift rod 9 and the second shift rod 11 meet that: the first shift rod 9 drives the cam 12 to rotate as being stopped by the first stop rod assembly 16, and then is separated from the first stop rod assembly 16 after the third curved surface of the contour surface 10 comes into contact with the driving arm end of the lever 3. The second shift rod 11 drives the cam 12 to rotate as being stopped by the second stop rod assembly 17, and then is separated from the second stop rod assembly 17 after the first curved surface of the contour surface 10 comes into contact with the driving arm end of the lever 3.

Figure 7:
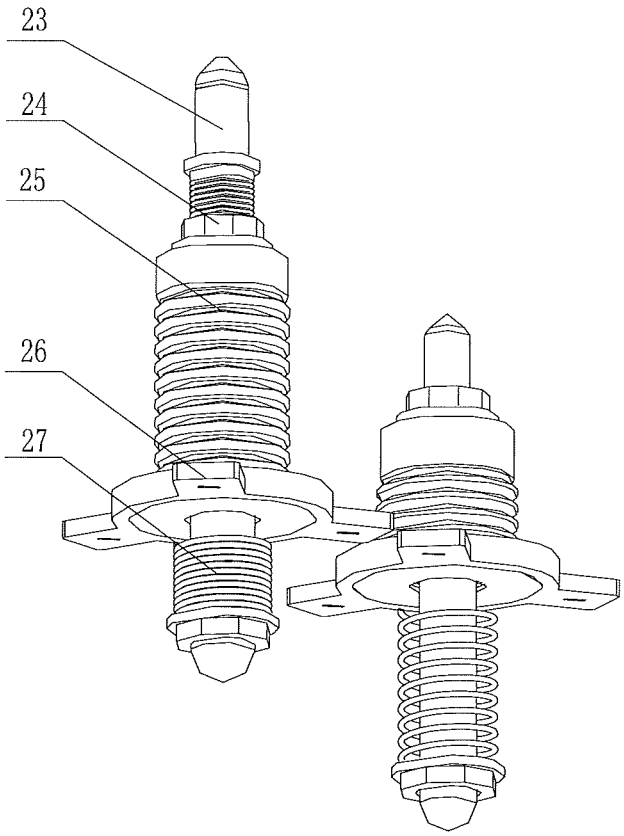
FIG. 7 is a stereoscopic view of a first stop rod assembly and a second stop rod assembly of the present invention.
Figure 8:
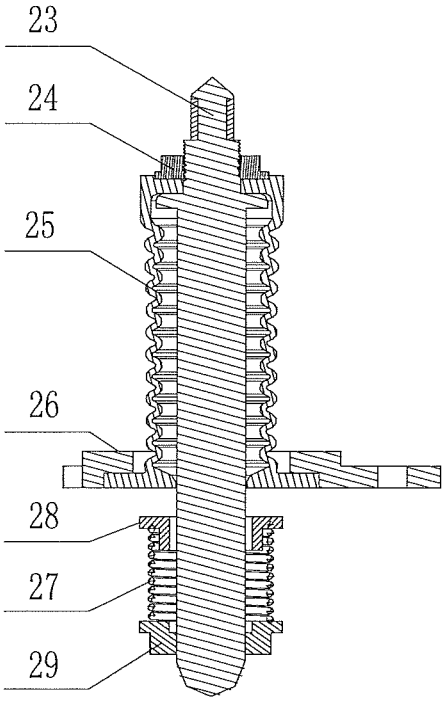
FIG. 8 is a cutaway view of the first stop rod assembly or the second stop rod assembly of the present invention.

As shown in FIG. 7 and FIG. 8, in the present invention, each of the first stop rod assembly 16 and the second stop rod assembly 17 comprises the stop rod 23, a nut 24, a sealing sleeve 25, a fixed disk 26 and a compression spring 27, and the stop rods 23 pass through the bottom wall of the outer tub 13. In the present invention, the stop rods 23 of the first stop rod assembly 16 and the second stop rod assembly 17 can move upwards and downwards to stop the first shift rod 9 and the second shift rod 11. The upper part of each stop rod 23 is located between the inner tub 1 and the outer tub 13, and the lower part of each stop rod 23 is located at the exterior of the bottom wall of the outer tub 13. Each sealing sleeve 25 is sleeve on the upper part of the corresponding stop rod 23 and can extend and contract along with the movement of the corresponding stop rod 23. One end of each sealing sleeve 25 is fixed on the corresponding stop rod 23 through the corresponding nut 24, and the other end of each sealing sleeve 25 is fixed on the bottom wall of the outer tub 13 in a sealed manner through the fixed disk 26, in order to ensure that a seal is provided between the first stop rod assembly 16 and the second stop rod assembly 17 and the outer tub 13 so as to prevent water leakage. The compression spring 27 is arranged at the lower part of the stop rod 23, a stop nut 29 for stopping one end of the compression spring 27 is arranged at the lower end of the corresponding stop rod 23. The compression spring 27 is arranged between the bottom wall of the outer tub 13 and the stop nut 29. Further, fixed seats 28 are mounted on the outer tub 13, the stop rods 23 pass through the fixed seats 28, and the compression springs 27 are arranged between the fixed seats 28 and the stop nuts 29. Thus the compression springs 27 do not exert force to the outer tub 13 while being pressed, which prevents damage to the outer tub 13 caused by frequent press.

In the present invention, the lever structure and the cam 12 are mounted between the inner tub 1 and the outer tub 13. A groove structure 15 is formed in the bottom wall of the outer tub 13 in order to provide enough space for mounting the lever structure and the cam 12. The first stop rod assembly 16 and the second stop rod assembly 17 are mounted in the groove structure 15, and the groove structure 15 is provided with a tub drainage hole of outer tub 14.

Figure 4:
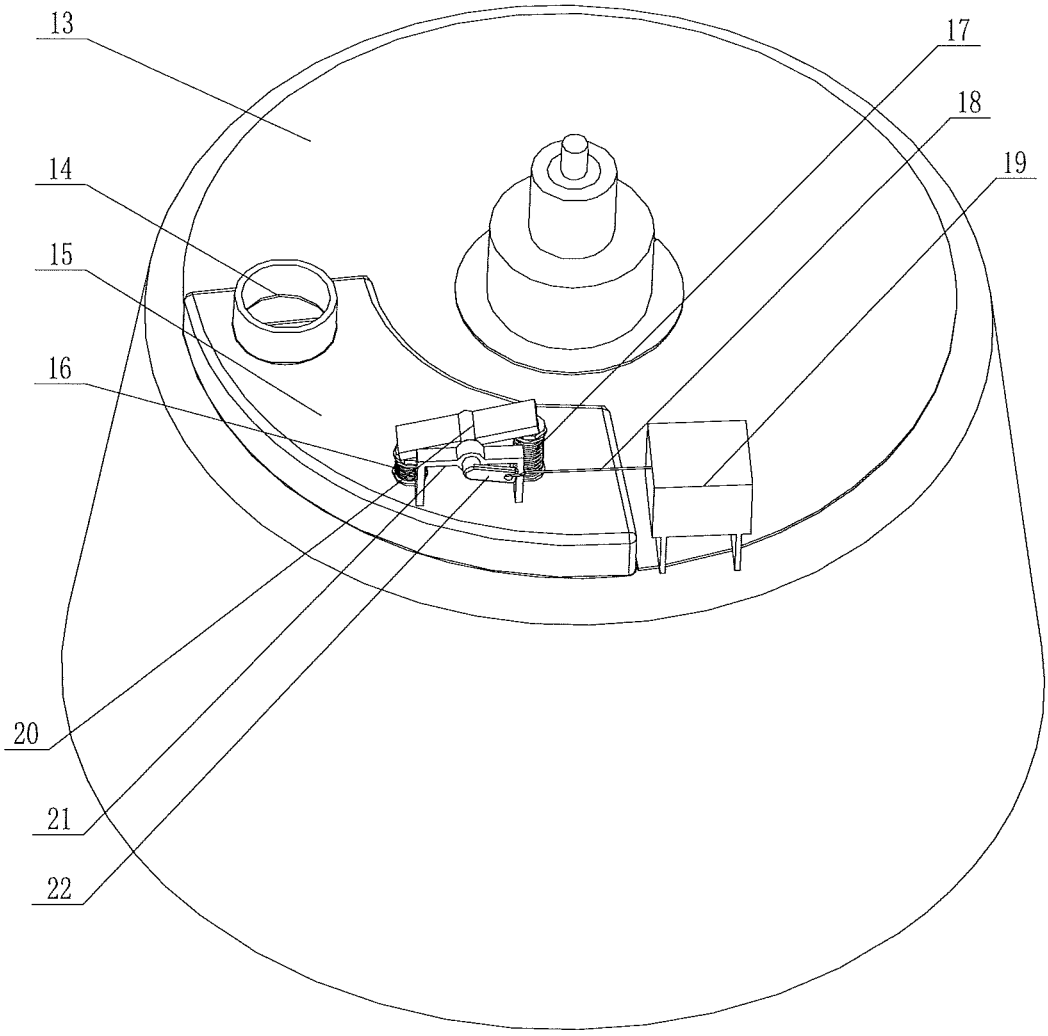
FIG. 4 is a stereoscopic view of a drainage structure mounted at the bottom of an outer tub of the present invention.
Figure 5:
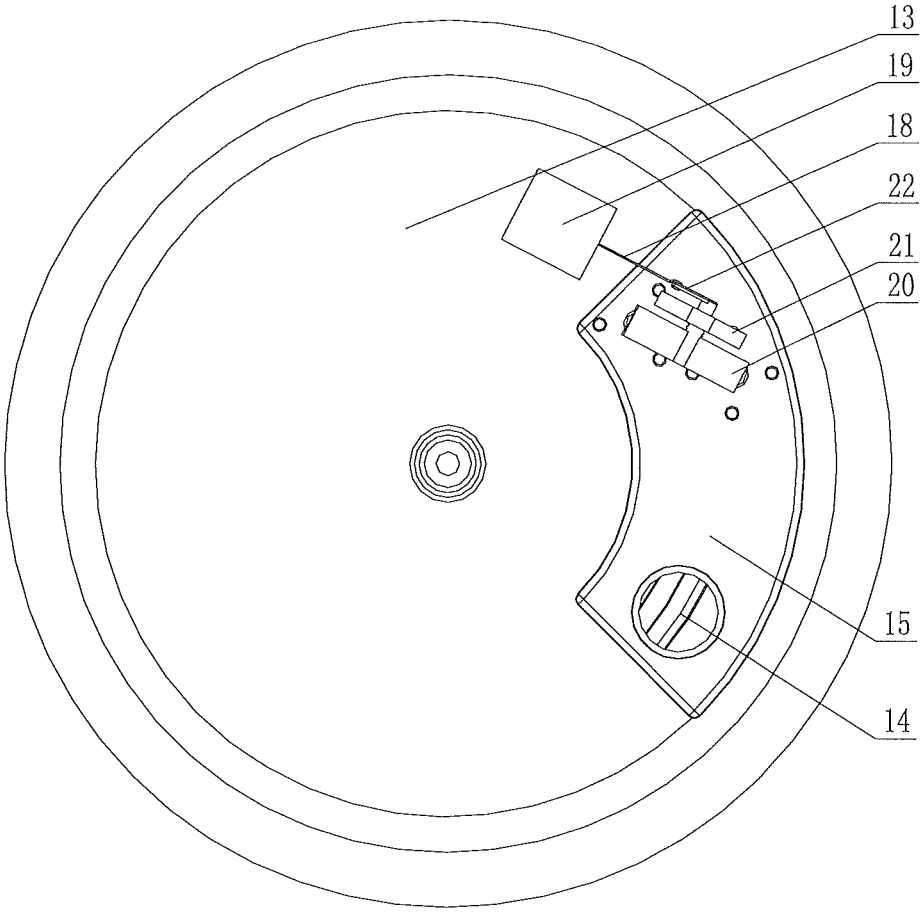
FIG. 5 is a top view of FIG. 4 of the present invention.
Figure 6:
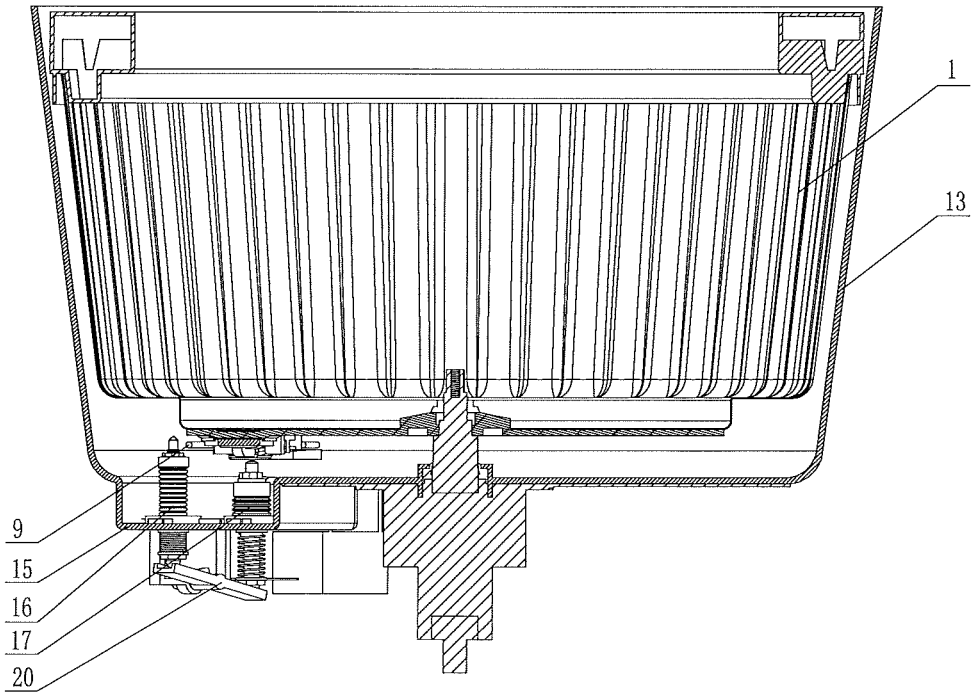
FIG. 6 is a cutaway view of FIG. 4 of the present invention.

In the present invention, in order to implement the upwards and downwards movement of the stop rods 23 of the first stop rod assembly 16 and the second stop rod assembly 17, as a preferred embodiment of the present invention, as shown in FIG. 4, FIG. 5 and FIG. 6, the driving device further comprises a press plate 20, a support 21, a pull rod 22 and a traction motor 19. The support 21 is fixed on the outer side of the bottom wall of the outer tub 13, the pull rod 22 is rotatably mounted on the support 21, one end of the pull rod 22 is connected with the traction motor 19, the other end of the pull rod 22 is fixedly connected with the press plate 20, and two ends of the press rod press the first stop rod assembly 16 and the second stop rod assembly 17, respectively.

The pull rod 22 and the press plate 20 rotate around the support 21 under the traction of the traction motor 19. One end of the press plate 20 moves upwards and presses the first stop rod assembly 16 to move upwards, the other end of the press plate 20 moves downwards and then the second stop rod assembly 17 moves downwards.

As a preferred embodiment of the present invention, the traction motor 19 is connected with the pull rod 22 through a stretching wire 18.

Embodiment 1

Figure 3:
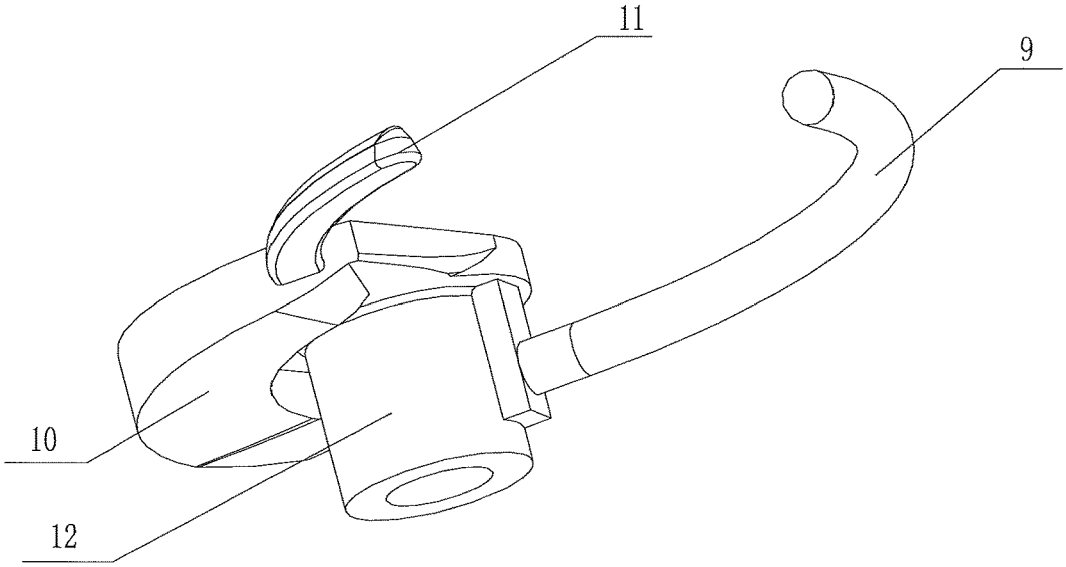
FIG. 3 is a stereoscopic view of a cam of the present invention.

As shown in FIG. 2 and FIG. 3, this embodiment is different from the above embodiments only in that a cam structure 12 suitable for the drainage mechanism of a washing machine of the present invention is provided. The whole cam structure 12 is of sector configuration, and the cam structure 12 is provided with a contour surface 10.

The cam 12 provided by the present invention is mounted on a bottom wall of an inner tub 1 of a washing machine, and as for the position of the cam 12 after being mounted, the contour surface is arranged on the upper surface of the cam 12.

In this embodiment, the cam 12 is provided with a first shift rod 9 and a second shift rod 11, the first shift rod 9 and the second shift rod 11 are both provided with a certain arc, and the centers of the arcs are located on the sides of the first stop rod assembly 16 and the second stop rod assembly 17. Therefore, when the first stop rod assembly 16 stops the first shift rod 9 and the second stop rod assembly 17 stops the second shift rod 11, the first stop rod assembly 16 slides out along the arc structure of the first shift rod 9 and the second rod assembly 17 slides out along the arc structure of the second shift rod 11, so that the action between the stop rod assemblies and the shift rods is more balanced, transition is smoother, and sudden change in rotation of the cam 12 is prevented.

Embodiment 2

Figure 12:
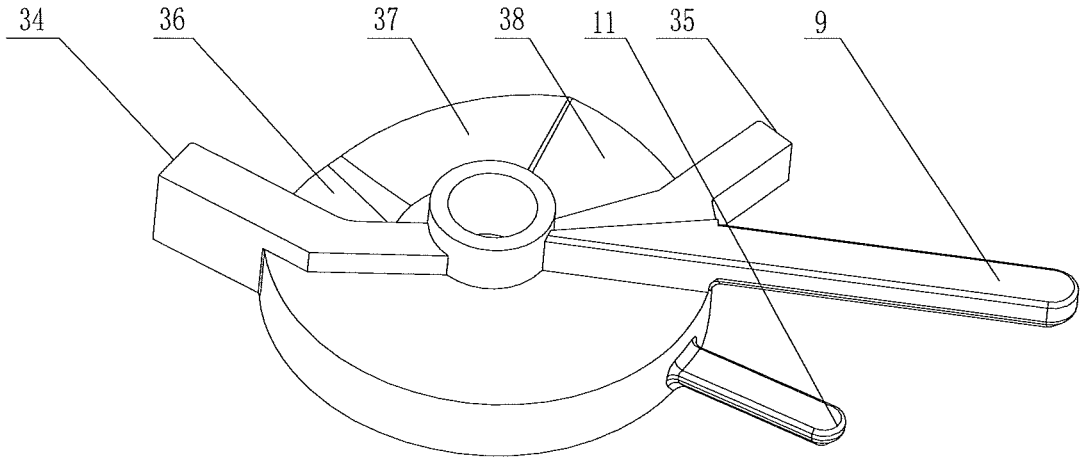
FIG. 12 is a stereoscopic view of Embodiment 2 of the present invention.
Figure 13:
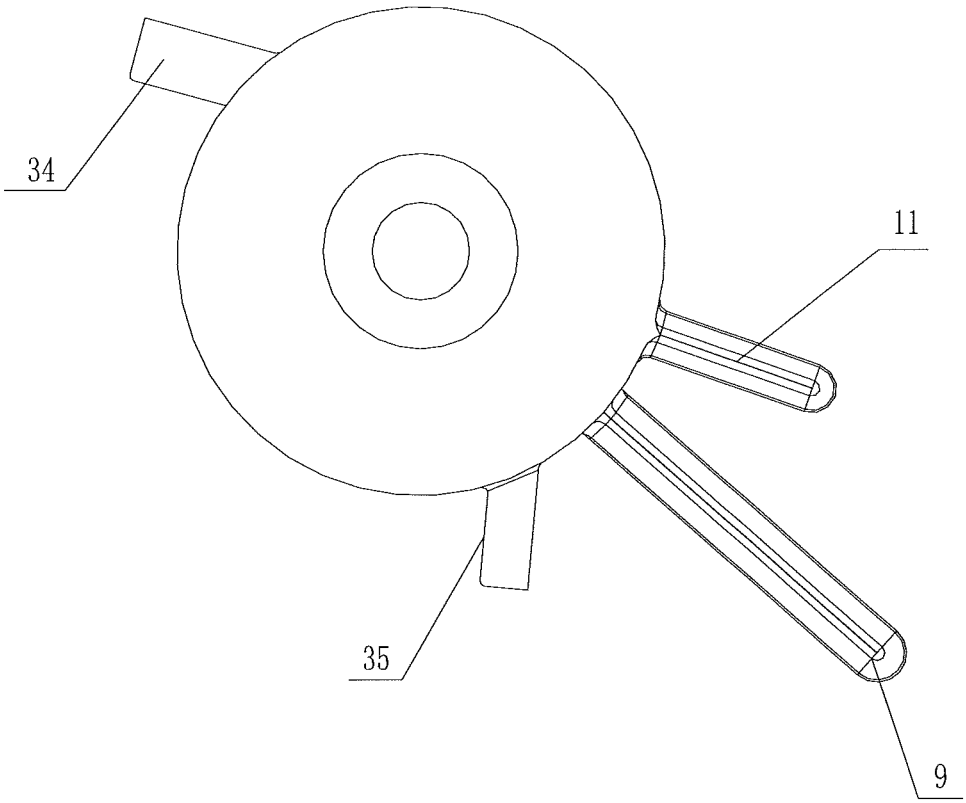
FIG. 13 is a front view of Embodiment 2 of the present invention.

As shown in FIG. 12 and FIG. 13, this embodiment is different from the above embodiments only in that a cam structure 12 suitable for the drainage mechanism of a washing machine of the present invention is further provided. The whole cam structure 12 is in a shape of cylinder, and a contour surface 10 is arranged on the cam structure 12. The cam 12 provided by the present invention is mounted on a bottom wall of an inner tub 1 of a washing machine, and as for the position of the cam 12 after being mounted, the contour surface 10 is arranged on the upper surface of the cam 12.

In this embodiment, the cam 12 is provided with a first shift rod 9 and a second shift rod 11.

In this embodiment, the cam 12 is further provided with a first limiting part 34 and a second limiting part 35. The first limiting part 34 is used for limiting the cam 12 so that the cam 12 stops rotating at a position where the water sealing cover 8 opens the drainage outlet, and the second limiting part 35 is used for limiting the cam 12 so that the cam 12 stops rotating at a position where the water sealing cover 8 closes the drainage outlet.

Therefore, a torus surface of the cam 12 cannot be wholly in contact with the lever structure due to a rotation limiting function of the first limiting part 34 and the second limiting part 35 to the cam 12, so, in this embodiment, the contour surface 10 is only arranged on a part, located between the first limiting part 34 and the second limiting part 35, of the upper surface of the cam 12.

In this embodiment, the contour surface 10 at least comprises a basic curved surface 36, a sliding curved surface 37 and a non-return curved surface 38. The vertical travel height of the basic curved surface 36 is the lowest, the vertical travel height of the sliding curved surface 37 gradually increases, the vertical travel height of the non-return curved surface 38 gradually decreases along with the maximum value of the vertical travel of the sliding curved surface 37, but decreases in a small amount. This is mainly determined by the open and close states of the drainage mechanism provided by the present invention. The water sealing cover 8 covers the drainage outlet when the basic curved surface 36 is in contact with the lever structure, and at this time, the drainage mechanism provided by the present invention is in the close state. The lever structure slides to a maximum travel position along the sliding curved surface 37 when the cam 12 rotates, the water sealing cover 8 opens the drainage outlet, and at this time, the drainage mechanism provided by the present invention is in the open state. The vertical travel of the non-return curved surface 38 is slightly smaller than the maximum travel of the sliding curved surface 37, so that the lever structure keeps a pressed state, and then the drainage mechanism provided by the present invention keeps the open state. If the drainage mechanism provided by the present invention needs to be closed again, it only needs to rotate the cam 12 in the reverse direction.

Thus, in the present invention, the first limiting part 34 and the second limiting part 35 are used for limiting the rotation of the cam 12. The cam 12 needs to stop rotating, after the cam 12 rotates to the positions of the basic curved surface 36 or the non-return curved surface 38. However, at this time, the cam 12 may continuously rotate under the action of inertia, which possibly results in that the water sealing cover 8 cannot normally open or close the drainage outlet or causes damage to the cam 12.

In this embodiment, the first limiting part 34 and the second limiting part 35 are both rod-shaped structures, and the first limiting part 34 and the second limiting part are both smaller than the first shift rod 9 and the second shift rod 11, so that the contact between the first shift rod 9 and the second shift rod 11 and the stop rod assemblies is not influenced.

Further, in this embodiment, the lengths of the first limiting part 34 and the second limiting part 35 are larger than a distance between the outmost circumference of the cam 12 and the lever support 6, so, the first limiting part 34 and the second limiting part 35 can be stopped by the lever support 6 after the cam 12 rotates to a specific position.

Embodiment 3

Figure 9:
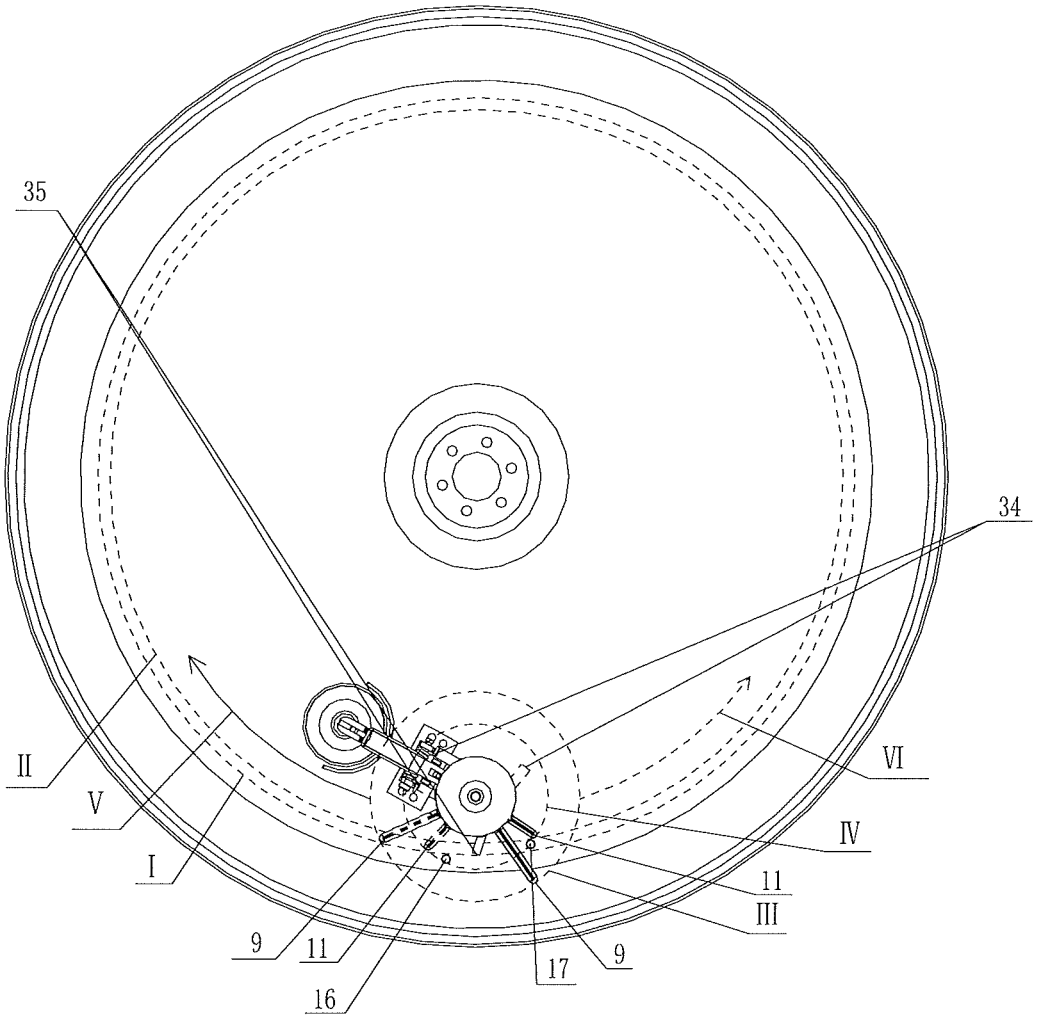
FIG. 9 is a schematic diagram of working principles of the present invention.
Figure 10:
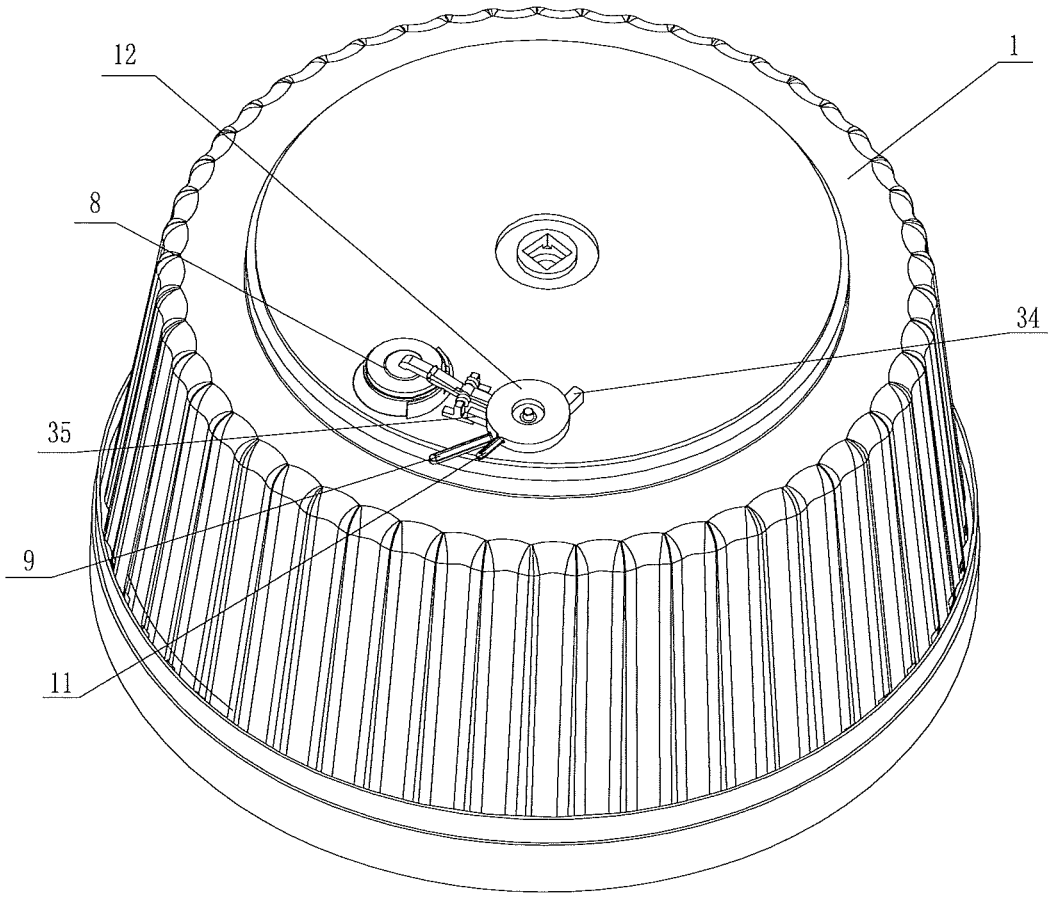
FIG. 10 is a stereoscopic view of a drainage structure in an opened state of the present invention.
Figure 11:
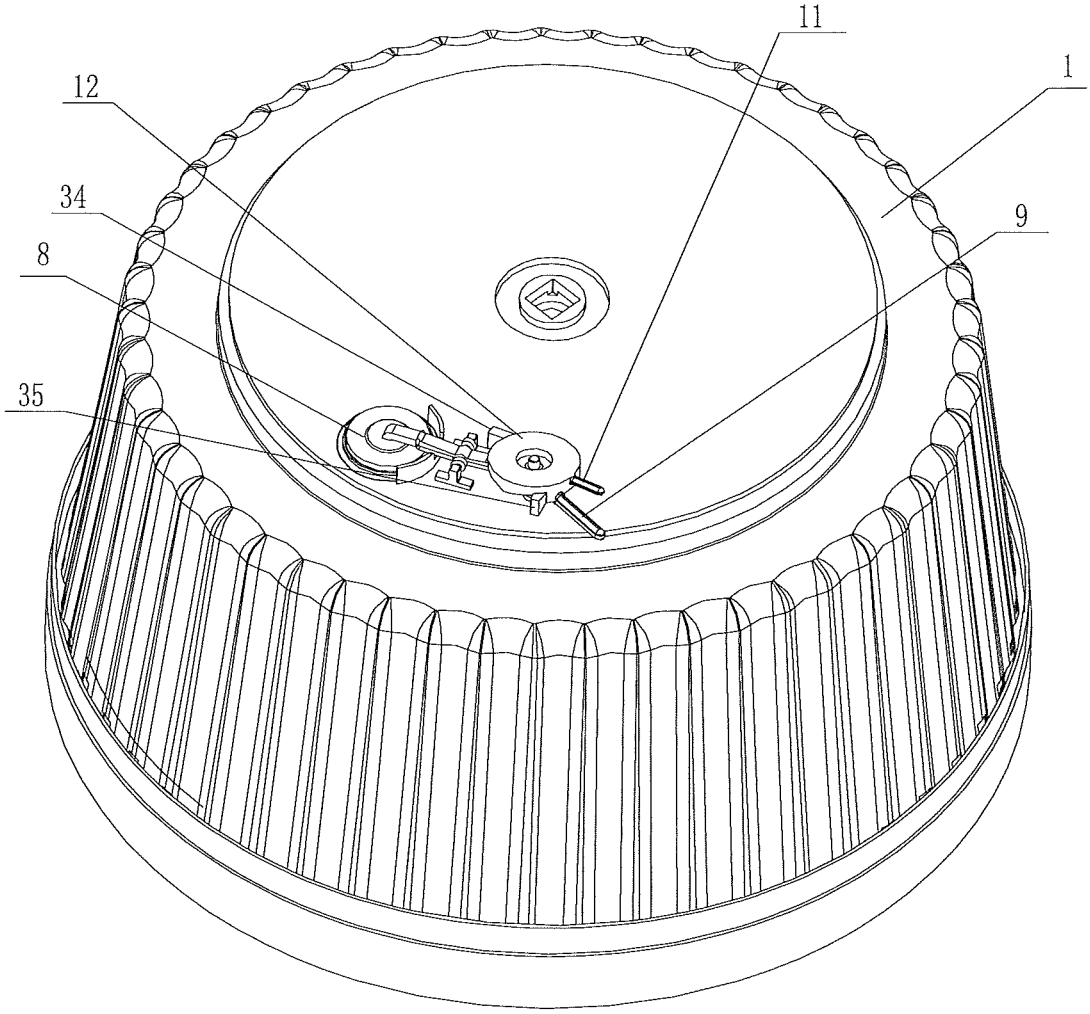
FIG. 11 is a stereoscopic view of a drainage structure in a closed state of the present invention.

As shown in FIG. 9, FIG. 10 and FIG. 11, this embodiment describes working principles of the drainage mechanism provided by the present invention in detail by taking Embodiment 2 as an example. As shown in FIG. 9, a solid arrow V and a dotted arrow VI are rotation directions of the inner tub 1. The solid arrow V is a rotation direction of the inner tub 1 when the drainage mechanism is to be closed, and the dotted arrow VI is a rotation direction of the inner tub 1 when the drainage mechanism is to be opened. As shown in FIG. 9, a circle dotted line I is a movement path of the first stop rod assembly 16 relative to the inner tub 1, and a circle dotted line II is a movement path of the second stop rod assembly 17 relative to the inner tub 1. A circle dotted line III is a movement path of the first shift rod 9 relative to the inner tub 1, and a circle dotted line IV is a movement path of the second shift rod 11 relative to the inner tub 1.

As shown in FIG. 9 and FIG. 10, the opening of the drainage mechanism provided by the present invention comprises the following procedures:

1) the inner tub 1 rotates in the direction of the dotted arrow VI in FIG. 9;
2) the traction motor 19 starts;
3) the traction motor 19 pulls the pull rod 22 to rotate, the pull rod 22 drives the press plate 20 to rotate around the support 21, one end, pressing the first stop rod assembly 16, of the press plate 20 moves upwards, and the first stop rod assembly 16 moves upwards under the pressure of the press plate 20;

4) the traction motor 19 stops pulling after the stop rod 23 of the first stop rod assembly 16 moves upwards to a position where the stop rod 23 can stop the first shift rod 9 of the cam 12;
5) the cam 12 rotates in the direction of the dotted arrow VI in FIG. 9 along with the inner tub 1, and the first shift rod 9 is stopped by the first stop rod assembly 16 when the cam 12 rotates to the position of the first stop rod assembly 16, so that the cam 12 rotates on its axis while rotating along with the inner tub 1;
6) the cam 12 rotates and drives the contour surface 10 to move, the driving arm end of the lever 3, relative to the contour surface 10, moves from the basic curved surface 36 to the sliding curved surface 37 and finally arrives at the non-return curved surface 38, and the cam 12 stops when the second limiting part 35 of the cam 12 is stopped by the lever support 6; and meanwhile, the first shift rod 9 rotates along the circle dotted line III, and when the first shift rod 9 rotates out of a cross area of the circle dotted line III and the circle dotted line I, the first shift rod 9 is separated from the first stop rod assembly 16; and 7) the driving arm end of the lever 3 moves upwards under the pressure of the non-return curved surface 38 of the contour surface 10 so as to drive the resistance arm end of the lever 3 to move downwards, the resistance arm end of the lever 3 drives the water sealing cover 8 to move downwards, and the drainage outlet is opened, thereby implementing drainage of the drainage mechanism provided by the present invention.

As shown in FIG. 9 and FIG. 11, the closing of the drainage mechanism provided by the present invention comprises the following procedures:

1) the inner tub 1 rotates in the direction of the solid arrow V in FIG. 9;
2) the traction motor 19 returns;
3) the pull rod 22 is driven by the return torsion spring 2 to return, the pull rod 22 drives the press plate 20 to reversely rotate around the support 21, one end, pressing the second stop rod assembly 17, of the press plate 20 moves upwards, and the second stop rod assembly 17 moves upwards under the pressure of the press plate 20;
4) the traction motor 19 returns to an initial position after the stop rod 23 of the second stop rod assembly 17 moves upwards to a position where the stop rod 23 can stop the second shift rod 11 of the cam 12;
5) the cam 12 rotates in the direction of the solid arrow V in FIG. 9 along with the inner tub 1, and the second shift rod 11 is stopped by the second stop rod assembly 17 when the cam 12 rotates to the position of the second stop rod assembly 17, so that the cam 12 rotates on its axis reversely while rotating along with the inner tub 1;

6) the cam 12 rotates reversely and drives the contour surface 10 to move, the driving arm end of the lever 3, relative to the contour surface 10, moves from the non-return curved surface 38 to the sliding curved surface 37 and finally returns to the basic curved surface 36, and the cam 12 stops when the first limiting part 34 of the cam 12 is stopped by the lever support 6; and meanwhile, the second shift rod 11 rotates along the circle dotted line IV, and when the second shift rod 11 rotates out of a cross area of the circle dotted line IV and the circle dotted line II, the second shift rod 11 is separated from the second stop rod assembly 17; and 7) the basic curved surface 36 of the contour surface 10 returns to the lower part of the driving arm end of the lever 3, the driving arm end of the lever 3 is not pressed any more, the resistance arm end of the lever 3 returns under the elastic action of the torsion spring 2, the resistance arm end of the lever 3 drives the water sealing cover to move upwards, and the drainage outlet is closed, thereby implementing the drainage of the drainage mechanism provided by the present invention.

What described above are only preferred embodiments of the present invention, but are not intended to limiting the scope of the present invention in any forms. Although the present invention has been disclosed in terms of preferred embodiment, it is not limited thereto. Without departing from the scope of the technical solution of the present invention, any persons skilled in the present invention can make equivalent embodiments with various alterations and modifications as equivalent variations by utilizing the above-mentioned technical contents. However, without departing from the contents of the technical solution of the present invention, any simple changes, equivalent variations and modifications made according to the technical essence of the present invention shall all be covered within the scope of the technical solution of the present invention.

The invention claimed is:

1. A drainage mechanism of a washing machine, the washing machine including an inner tub without holes in a lower part of a side wall of the inner tub and an outer tub coaxially mounted outside the inner tub, the drainage mechanism comprising:

a water sealing cover;

a lever structure;

a driving device;

the lever structure including a lever and a lever support, the lever having a driving arm end and a resistance arm end, the resistance arm end of the lever being connected with the water sealing cover, the driving device being arranged at the driving arm end of the lever, wherein the driving device comprises a cam being rotatably mounted on an outer side of a bottom wall of the inner tub, the cam having a contour surface arranged below the driving arm end of the lever, and the cam is provided with a first shift rod and a second shift rod;

a drainage outlet being formed in the bottom wall of the inner tub; and a first stop rod assembly and a second stop rod assembly, both of which are mounted on a bottom wall of the outer tub; wherein when the inner tub rotates in a forward direction, the first stop rod assembly is configured to stop the first shift rod so that the cam rotates in a reverse direction, the contour surface presses the lever structure, and the water sealing cover opens the drainage outlet, and when the inner tub rotates in the reverse direction, the second stop rod assembly is configured to stop the second shift rod so that the cam rotates in the forward direction, the contour surface loosens the lever structure, and the water sealing cover closes the drainage outlet.

2. The drainage mechanism of a washing machine according to claim 1, wherein, the lever support is fixed on the outer side of the bottom wall of the inner tub, the lever is rotatably mounted on the lever support, and the driving device drives the lever to rotate around the lever support.

3. The drainage mechanism of a washing machine according to claim 1, wherein, the water sealing cover is connected with the resistance arm end of the lever structure through a hinge, the water sealing cover freely rotates around a center line of the resistance arm end of the lever structure, and a movable included angle of 0-15 degrees is formed between the water sealing cover and the bottom wall of the inner tub.

4. The drainage mechanism of a washing machine according to claim 1, wherein, the cam is further provided with a first limiting part and a second limiting part, the first limiting part is used for limiting the cam so that the cam stops rotating at a position where the water sealing cover opens the drainage outlet, and the second limiting part is used for limiting the cam so that the cam stops rotating at a position where the water sealing cover closes the drainage outlet.

5. The drainage mechanism of a washing machine according to claim 1, comprising:

a torsion spring for returning the lever when the contour surface loosens arranged between the lever and the lever support of the lever structure, and the torsion spring deforms when the contour surface presses the driving arm of the lever and recovers when the contour surface loosens the driving arm of the lever.

6. The drainage mechanism of a washing machine according to claim 1, wherein, each of the first stop rod assembly and the second stop rod assembly comprises a stop rod configured to move upwards and downwards;

the first stop rod assembly is arranged outside the second stop rod assembly, and a length of the first shift rod is larger than a length of the second shift rod, so that the stop rod of the first stop rod assembly only stops the first shift rod when moving upwards; and the length of the stop rod of the second stop rod assembly is smaller than the length of the stop rod of the first stop rod assembly, and a distance between the second shift rod and the bottom wall of the outer tub is smaller than a distance between the first shift rod and the bottom wall of the outer tub, so that the stop rod of the second stop rod assembly only stops the second shift rod when moving upwards.

7. The drainage mechanism of a washing machine according to claim 1, wherein, each of the first stop rod assembly and the second stop rod assembly comprises a sealing sleeve and the stop rod configured to move upwards and downwards, an upper part of each stop rod passes through the bottom wall of the outer tub and is located between the inner tub and the outer tub, a lower part of each stop rod is located at an exterior of the bottom wall of the outer tub, each sealing sleeve is sleeved on the upper part of each stop rod and extends and contracts along with the movement of each stop rod, and another end of each sealing sleeve is in seal connection with the bottom wall of the outer tub.

8. The drainage mechanism of a washing machine according to claim 7, wherein, each of the first stop rod assembly and the second stop rod assembly further comprises a compression spring, each compression spring is arranged at a lower part of each stop rod, one end of each compression spring abuts against the bottom wall of the outer tub, and another end of each compression spring abuts against a lower end of each stop rod, and each compression spring is compressed when each stop rod moves upwards and is used for providing an elastic force for each stop rod to make the corresponding stop rod to move downwards and return.

9. The drainage mechanism of a washing machine according to claim 1, wherein, the driving device comprises a press plate, a support, a pull rod and a traction motor, the support of the driving device is fixed on an outer side of the bottom wall of the outer tub, the pull rod is rotatably mounted on the support, one end of the pull rod is connected with the traction motor, another end of the pull rod is fixedly connected with the press plate, and two ends of the press plate respectively press the first stop rod assembly and the second stop rod assembly; and the pull rod and the press plate rotate around the support under the traction of the traction motor, and when one end of the press plate moves upwards and presses the first stop rod assembly to move upwards, another end of the press plate moves downwards and the second stop rod assembly moves downwards.

10. The drainage mechanism of a washing machine according to claim 3, wherein, the movable included angle is 5 degrees.

* * * * *